US005454425A

United States Patent [19]

Kao

[11] Patent Number: 5,454,425

[45] Date of Patent: Oct. 3, 1995

[54] METAL MATRIX COMPOSITE MADE WITH REDUCED INTERFACE REACTIONS

[75] Inventor: Wei H. Kao, Rancho Palos Verdes, Calif.

[73] Assignee: The Aerospace Corporation, El Segundo, Calif.

[21] Appl. No.: 595,884

[22] Filed: Apr. 2, 1984

[51] Int. Cl.[6] ..... B22C 1/00

[52] U.S. Cl. ..... 164/520; 428/549; 428/608

[58] Field of Search ..... 164/520; 75/20 F; 428/546, 570, 549, 608; 425/78

[56] References Cited

U.S. PATENT DOCUMENTS 3,861,839 1/1975 Malik ..... 425/78

3,940,262 2/1976 Niebylski ..... 428/546

*Primary Examiner*—Donald P. Walsh

*Attorney, Agent, or Firm*—WIlliam J. Burke

[57] ABSTRACT

A metal matrix composite is produced by closely aligning together a sheet of hydrided or hydrogenated alloy with a filament preform at a relatively low temperature. The resulting metal matrix will have a minimum of excessive chemical reactions at the alloy-filament interface thereby allowing the composite to achieve theoretical mechanical property values.

14 Claims, No Drawings

METAL MATRIX COMPOSITE MADE WITH REDUCED INTERFACE REACTIONS

STATEMENT OF GOVERNMENT INTEREST

The invention described herein may be manufactured and used by or for the Government of the United States for governmental purposes without the payment of a royalty therefor.

BACKGROUND OF THE INVENTION

1. Field of the Invention

The invention relates generally to the field of fiber reinforced metal matrix composites and specifically to hydrided metal alloys that enhance mechanical properties of the composite without deleterious chemical reactions at the interface thereof.

2. Prior Art

In the past, the fabrication of the metal matrix composite usually involves pressing filaments and matrix metals together at a relatively high temperature for a set period of time to achieve proper consolidation and bonding.

However, the properties obtained from the fabricated composites were usually less than the theoretical predictions based on the principle of rule of mixtures.

It is well established that the excessive reactions that occurred between the fiber and the matrix metal were the major reason for composites not achieving the predicted theoretical properties. Such reactions would usually form compounds at the interface between filament and matrix metal, and were detrimental to the desired composite properties. Accordingly, it was deemed desirable to find a method of minimizing such reactions to permit the composites to achieve the mechanical property values predicted by theory.

SUMMARY OF THE INVENTION

It is an important object of the invention to form a metal matrix composite of hydrided metal at a relatively low temperature that allows a minimum of deleterious chemical reactions to be conducted at the metal-fiber interface.

It is another object of the invention to use titanium alloy as the hydrided metal to achieve an optimal strength to weight ratio.

DESCRIPTION OF THE PREFERRED EMBODIMENT

The present invention discloses a method for fabricating a metal matrix composite at a substantially lower minimum forming temperature than that required for similar prior art composites through the use of hydrided metal. The deleterious chemical reaction that forms a brittle layer at the interface of the reinforcing filaments and the matrix metal can thus be reduced, thus permitting the composite to achieve its theoretical mechanical property values.

Metal matrix composites are made by reinforcing metals with high strength filaments. The resulting composite provides strength, stiffness and high temperature properties that could not be achieved by metals alone. Metal matrix composites must be fabricated at relatively high temperatures so that the metal matrix can flow into the filament spacings and form a proper bond therebetween with the filaments. As an example, the conventional or prior art practice in the fabrication of titanium alloy composites has been to use titanium alloy foils pressed together with reinforcing filaments. A temperature of approximately 1650°–1800° F. under a pressure of 5000 psi for at least an average of 30 minutes was needed for composite to be fully dense or consolidated and form proper bonding.

In general, excessive chemical reactions at the interface between the filament and the matrix metal occurs during this composite fabrication process. These reactions, which are usually diffusion controlled processes, are sensitive to temperature. Therefore, minimizing the fabrication temperature is essential for reducing the extent of the interface reactions.

Introducing a predetermined amount of hydrogen into titanium alloys will cause titanium hydrides to form. The existence of a hydride phase lowers the high temperature yield stresses for the metal, and therefore, the metal can be deformed with less external stress. Because less stress is needed to deform the metal when the temperature is increased, it can be expected that composites in which hydrided alloy is used as a matrix metal can be fabricated with lower temperatures when the same external stress is applied.

Hydrogen can best be introduced into titanium and its alloys by means of powders. Established commercial practices such as thermal heat treatments can be used to introduce approximately less than four percent hydrogen by weight into titanium alloys. The resultant hydride alloys can be deformed at lower temperatures than those alloys that are identical except for the hydrogen content. Likewise, hydrogen can be removed from metals easily also by means of thermal heat treatment such as vacuum annealing.

Hydride powder can be made from metals other than titanium alloys. Other metals include zirconium, hafnium, tantalum, columbium, uranium, and rare earth elements. Titanium alloys are preferred in this invention because of their pronounced hydrogen or hydriding effects.

The forms of the matrix alloy in this invention are not limited to power insomuch as foils may also be used.

Metal matrix composites use a titanium alloy metal matrix comprising (before hydriding) 90% titanium, 6% aluminum and 4% vanadium.

In practice, titanium hydride powder is glued together as sheets using commercially available polymeric bonding agents. Commercially available filaments of carbon and/or graphite and/or carbide and/or silicon and/or combinations thereof are also bonded together as preforms with predetermined spacings. Metal powder sheets and filament preforms are then stacked together in a die or any type of commercially available collapsible container. Dynamic vacuum is then employed throughout the fabrication process to prevent oxidation. In addition, dynamic vacuum is also used to remove the polymeric bonding agent during heating, and to partially or completely remove the evolving hydrogen during the fabrication process. The stack is then pressed at a lower temperature of approximately 1400° F. under approximately 5000 psi while under dynamic vacuum from approximately a minimum of a half hour to two hours of duration as required. The temperature 1400° F. being the approximate minimum temperature wherein the composite will be fully dense (without voids). In addition, the composite may also be cooled under dynamic vacuum to prevent oxidation. It will be appreciated that the above temperature is substantially lower and thus potentially less damaging to the metal matrix than that used by the noted prior art process. It will be further appreciated that the lower forming temperature of approximately 1400° F. allows for a thinner brittle layer, as mentioned supra, and therefore a longer service life at elevated temperatures then that of prior art materials due to the continued growth of such brittle layers at these elevated temperatures.

An exemplary metal matrix or composite panel would use a hydride powder with a metal alloy consisting of 90% titanium, 6% aluminum and 4% vanadium, as indicated, supra, that has been reinforced with commercially available silicon carbide filaments, such as model SCS-6 manufactured by AVCO. The panel would then be hot pressed under a dynamic vacuum at a lower temperature of approximately 1400° F. for two hours or less. After this has been done, the ambient temperature properties of the pressed metal matrix composite using metal alloy hydrides comprises 26% by volume of reinforcing filament, $200\times10^3$ psi of longitudinal tensile strength, $27\times10^6$ psi of modulus, and 0.77 of strain to failure.

Dehydriding of the titanium hydride powder components can produce very fine microstructures with improved mechanical properties. Insomuch as the transverse strength of the composite material is mainly controlled by the matrix alloy properties, the use of hydride alloys represents a method of manipulating metal matrix microstructures thereby improving the transverse strength of the resultant composite.

A feature of the invention is that it is a method for producing titanium metal matrix composites using hydride as the metal matrix. The hydrogen content of about one to four percent by weight of the titanium hydride enables the composite to be fabricated to full density and reach proper bonding under a dynamic vacuum at a lower temperature of approximately 1400° F., under a pressure of approximately 5000 psi, (as between the metal and the fiber) in about a minimum of a half hour to two hours, as required. Such a composite, even with the maximum of two hours of fabrication time, has substantially less reaction at the filament-matrix interface than that of the prior art. It will be noted that residual hydrogen, if any, can be removed by vacuum annealing the composite at approximately 1300° F. The removal of the hydrogen from the metal matrix produces a product that is relatively less brittle. Subsequent to the dynamic vacuum annealing, dynamic vacuum cooling may be performed on the metal matrix to disallow oxidation while it is still warm, and thereby be relatively more susceptible to oxidation.

Additional features of the invention include the fact that the metal used is not limited to the shape of the powder, but rather alloy foils may also be used. Also, the use of hydride powder as the matrix alloy provides a method of manipulating the microstructures of the matrix metal, and therefore, of improving the transverse strength of the composite. The invention represents a relatively lower cost approach for manufacturing composites, because lower temperatures allow for shorter processing time.

From the foregoing description of a specific embodiment illustrating the fundamental features of the invention, it will now be apparent to those skilled in the art that the invention may be accomplished in a variety of forms without departing from the spirit and scope thereof. Accordingly, it is understood that the invention disclosed herein is a preferred embodiment thereof, and that the invention is not to be limited thereby, but only by the appended claims.

What is claimed:

1. An improved process for reinforcing a metal matrix with fibers for fabrication of a composite comprising:

a) preparing a metal matrix from a particulate metal substantially hydrided, b) interfacing the hydrided matrix metal with the fibers, c) bonding the matrix metal to the fibers under pressure and at an elevated temperature for a predetermined time duration, and d) removing hydrogen evolved from the hydrided matrix metal during dehydridation.

2. The process of fabricating a composite as in claim 1 wherein the predetermined concentration of hydrogen in the hydrided metal matrix is in the range of approximately less than four percent by weight.

3. The process of fabricating a composite as in claim 1 wherein the step of interfacing the hydrided metal matrix with the fiber tow is carried out in a relative dynamic vacuum.

4. The process of fabricating a composite as for claim 1 wherein the step of interfacing the hydrided metal matrix with the fiber tow is performed at the predetermined pressure of approximately 5000 psi.

5. The process of fabricating a composite as for claim 1 wherein the step of interfacing the hydrided metal matrix with the fiber tow is performed at the predetermined lower temperature of approximately 1400° F. for allowing the matrix to be fully dense.

6. The process of fabricating a composite as in claim 1 whereby the step of interfacing the hydrided metal matrix with the fiber tow is performed at the predetermined duration within the range of one half hour to two hours.

7. The process of fabricating a composite as in claim 1 wherein the step of interfacing the hydrided metal matrix with the fiber tow is performed using an alloy as the metal matrix.

8. This process of fabricating a composite as in claim 7 wherein the step of interfacing the hydrided matrix metal with the fiber tow is performed using a metal matrix alloy having a concentration of 90% titanium, 6% aluminum, and 4% vanadium by weight.

9. The process of fabricating a composite as in claim 1 wherein the step of interfacing the hydrided matrix metal with the fiber tow is performed using an element as the metal matrix selected from the group consisting of titanium, zirconium, hafnium, tantalum, columbium, uranium, and rare earth elements.

10. The process of fabricating a composite as in claim 1 wherein the step of interfacing the hydrided matrix metal with the fiber tow wherein the metal matrix is titanium.

11. The process of fabricating a composite as in claim 1 wherein the step of interfacing the hydrided metal with the fiber tow wherein the metal matrix is titanium alloy.

12. The process of fabricating a composite as in claim 1 including the additional step of annealing in a dynamic vacuum the composite at a predetermined temperature to remove the residual hydrogen.

13. The process of fabricating a composite as in claim 12 wherein the annealing step is performed at the predetermined temperature of approximately 1300° F.

14. The process of fabricating a composite in claim 12 including the additional step of cooling the composite at a predetermined rate in a dynamic vacuum to prevent oxidation.

* * * * *